US010642200B2

(12) United States Patent
Sasaoka et al.

(10) Patent No.: US 10,642,200 B2
(45) Date of Patent: May 5, 2020

(54) FIXING DEVICE WITH TILTABLE SPACER BETWEEN HEATER AND SAFETY

(71) Applicant: CANON KABUSHIKI KAISHA, Tokyo (JP)

(72) Inventors: Osamu Sasaoka, Kawasaki (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/823,312

(22) Filed: Nov. 27, 2017

(65) Prior Publication Data

US 2018/0150001 A1 May 31, 2018

(30) Foreign Application Priority Data

Nov. 30, 2016 (JP) ..... 2016-233356

(51) Int. Cl.

*G03G 15/20* (2006.01)
*G03G 15/00* (2006.01)
*G03G 21/16* (2006.01)

(52) U.S. Cl.

CPC ..... *G03G 15/2017* (2013.01); *G03G 15/205* (2013.01); *G03G 15/55* (2013.01); *G03G 15/80* (2013.01); *G03G 15/2039* (2013.01); *G03G 15/2064* (2013.01); *G03G 15/5004* (2013.01); *G03G 15/5012* (2013.01); *G03G 15/553* (2013.01); *G03G 21/1652* (2013.01); *G03G 21/1685* (2013.01); *G03G 2215/2003* (2013.01); *G03G 2215/2035* (2013.01); *G03G 2221/166* (2013.01); *G03G 2221/1639* (2013.01)

(58) Field of Classification Search

CPC ..... G03G 15/2017; G03G 15/2039; G03G 15/205; G03G 15/2078; G03G 15/5004; G03G 15/4012; G03G 15/80; G03G 15/2064; G03G 21/1652; G03G 21/1685; G03G 2215/2003; G03G 2221/1639; G03G 2221/166; G03G 15/5012

See application file for complete search history.

(56) References Cited

U.S. PATENT DOCUMENTS

2014/0093268 A1* 4/2014 Iwasaki ..... G03G 15/2039 399/70
2015/0227091 A1* 8/2015 Ando ..... G03G 15/2046 399/33

FOREIGN PATENT DOCUMENTS

JP 2013-041096 A 2/2013

* cited by examiner

*Primary Examiner* — Joseph S Wong
(74) *Attorney, Agent, or Firm* — Canon U.S.A., Inc., IP Division

(57) ABSTRACT

There is provided a fixing device, in which an operation delay of a safety element is unlikely to occur even if a heater tilts. The fixing device includes a spacer disposed between the heater and the safety element, wherein an area of the spacer in contact with the safety element is smaller than an area of the spacer in contact with the heater, and the spacer is tiltable relative to the safety element.

3 Claims, 8 Drawing Sheets

FIXING DEVICE WITH TILTABLE SPACER BETWEEN HEATER AND SAFETY

BACKGROUND

Field of the Disclosure

The present disclosure relates to a fixing device to be included in a copying machine or printer employing an electrophotographic recording system.

Description of the Related Art

As one type of fixing device to be included in a copying machine or printer employing an electrophotographic recording system, there is a fixing device employing a film heating system using a cylindrical film. The fixing device employing the film heating system includes a cylindrical film, a heater in contact with an inner surface of the film, and a pressure roller forming a fixing nip portion with the heater via the film. The heater is held by a heater holder made of resin. The heater holder is reinforced by a metal reinforcing member. The heater holder has a through hole. A temperature detection element is provided in a space between the heater holder and the reinforcing member. The temperature detection element detects the temperature of the heater via the through hole of the heater holder. The heater is controlled according to the temperature detected by the temperature detection element. A safety element such as a thermal switch is also provided in the space between the heater holder and the reinforcing member. The safety element also is disposed to receive heat from the heater, via another through hole provided in the heater holder. The safety element has a role of interrupting power supply to the heater when the temperature of the heater reaches an excessive temperature. To operate quickly in response to the excessive temperature of the heater, the safety element is made of a material having high thermal conductivity such as metal, in many cases.

However, if the safety element is made of metal, the safety element has a large heat capacity. Consequently, if the safety element is brought into direct contact with the heater, the heat of the heater is lost at startup of an apparatus. If a heat quantity of the heater is not sufficient, a toner image is not fixed reliably in some cases. Accordingly, it is necessary to delay start of printing, until the safety element is sufficiently warmed. This delay increases the time necessary for completion of printing, thereby causing a user to feel stress.

To avoid such an issue, there has been suggested a technique of reducing conduction of heat to the safety element by placing a spacer between the safety element and the heater (as discussed in Japanese Patent Application Laid-Open No. 2013-41096). At an abnormally high temperature, the spacer melts, which brings three components, i.e., the safety element, the melted spacer, and the heater, into tight contact with each other to transfer the heat. As a result, power supply to the heater is interrupted.

However, in the device having the spacer as discussed in Japanese Patent Application Laid-Open No. 2013-41096, the following issues may occur. It is conceivable that, if the heater tilts relative to the safety element when, for example, the heater moves to release the pressure of the fixing nip portion, a large gap is formed between the heater and the spacer. If abnormal heat generation of the heater occurs in such a state, there is a possibility that it takes a long time for the spacer to melt due to a decrease in the quantity of heat from the heater to the spacer, and thereby an operation delay of the safety element occurs.

SUMMARY

The present disclosure is directed to a fixing device in which an operation delay of a safety element is unlikely to occur even if a heater tilts.

According to an aspect of the present disclosure, a fixing device for fixing an image formed on a recording material onto the recording material includes a film having a cylindrical shape, a heater in contact with an inner surface of the film, a roller forming a fixing nip portion with the heater via the film, a safety element having a switch portion that operates by receiving heat from the heater, and configured to interrupt power supply to the heater, and a spacer disposed between the heater and the safety element, wherein the fixing device fixes the image formed on the recording material onto the recording material by using heat of the heater, while pinching and conveying the recording material at the fixing nip portion, and wherein an area of the spacer in contact with the safety element is smaller than an area of the spacer in contact with the heater, and the spacer is tiltable relative to the safety element.

Further features of the present disclosure will become apparent from the following description of exemplary embodiments with reference to the attached drawings.

DESCRIPTION OF THE EMBODIMENTS

Figure 1:
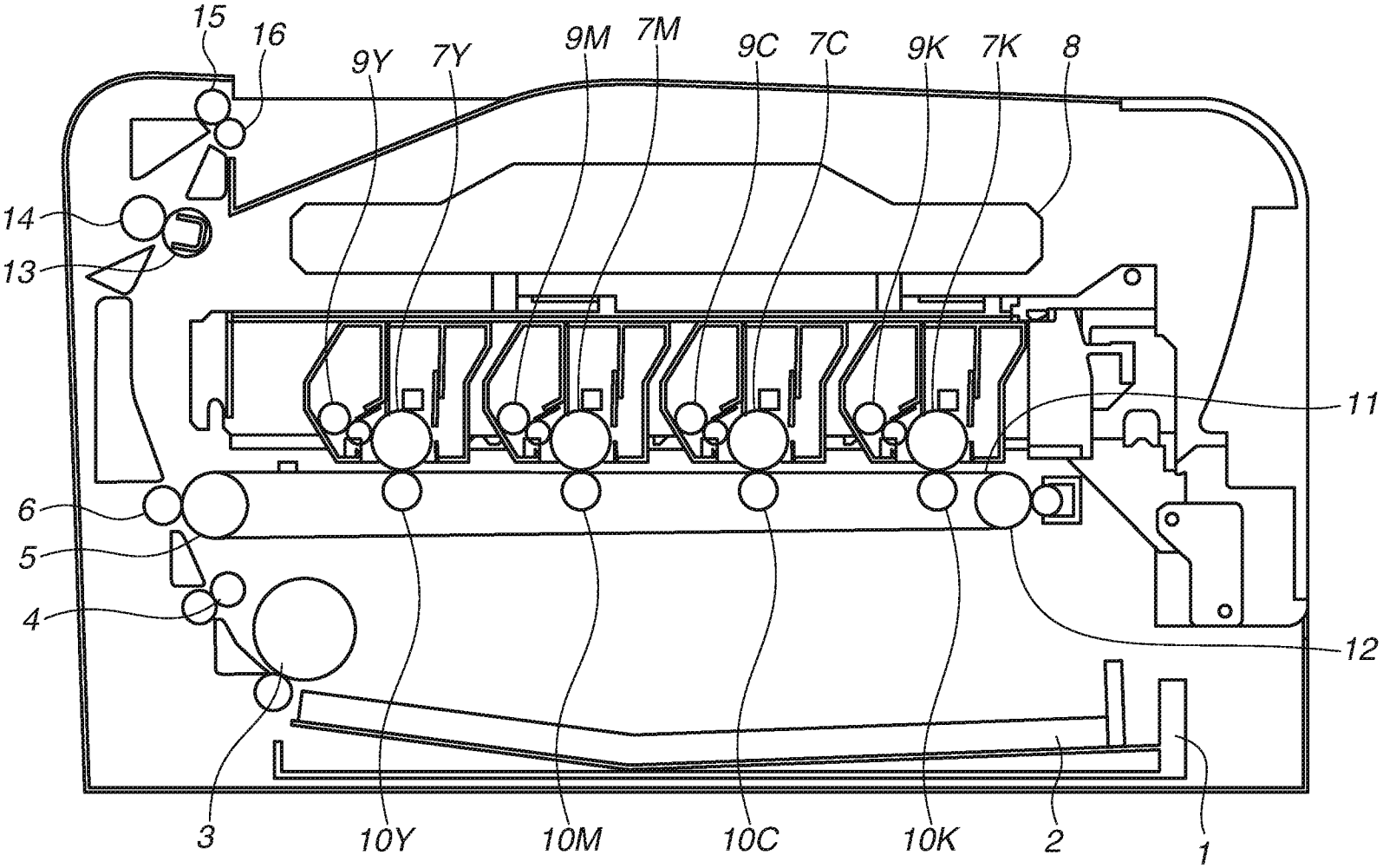
FIG. 1 is a schematic cross-sectional diagram illustrating an image forming apparatus, according to one or more embodiments of the subject disclosure.

Various exemplary embodiments, features, and aspects of the disclosure will be described in detail below with reference to the drawings.

(Overall Configuration of Image Forming Apparatus)

An overview of an overall configuration of an image forming apparatus will be described with reference to FIG. 1. Recording materials 2 are stacked in a sheet tray 1, and each fed to a conveyance roller 4, by a feed roller 3 rotating clockwise in FIG. 1. The recording material 2 is then conveyed to a nip portion between a driving roller 5 disposed inside an intermediate transfer belt 11, and a secondary transfer roller 6.

Photosensitive drums 7Y, 7M, 7C, and 7K each serve as an image carrying member of an image forming unit, and rotate counterclockwise in FIG. 1. In each of the image forming units, an electrostatic latent image is formed on an outer peripheral surface of the photosensitive drum by a laser beam from a laser scanner 8, sequentially. The electrostatic latent images are then developed by developing rollers 9Y, 9M, 9C, and 9K, respectively, and toner images are thereby formed. Primary transfer units 10Y, 10M, 10C, and 10K press and apply voltages to the toner images formed on the photosensitive drums 7Y, 7M, 7C, and 7K, respectively. The toner images are thereby transferred to the intermediate transfer belt 11. The intermediate transfer belt 11 is stretched by members such as the driving roller 5 and a tension roller 12. The intermediate transfer belt 11 is moved at substantially the same speed as the moving speed of the photosensitive drums 7M, 7C, and 7K, by the driving roller 5 driven to rotate clockwise in FIG. 1.

In a case where a color image is formed, yellow, magenta, cyan, and black toner images are developed on the photosensitive drums 7Y, 7M, 7C, and 7K, respectively. The toner images formed on the photosensitive drums 7Y, 7M, 7C, and 7K are sequentially transferred to the intermediate transfer belt 11 by the primary transfer units 10Y, 10M, 10C, and 10K, respectively. The toner images formed on the intermediate transfer belt 11 are then collectively transferred onto the recording material 2 conveyed to the nip portion between the driving roller 5 and the secondary transfer roller 6. Further, the recording material 2 onto which the toner images are transferred is conveyed to a fixing nip portion formed between a heating unit 13 and a pressure roller 14. At the fixing nip portion, the toner images are fixed onto the recording material 2, by being heated and pressurized. A discharge roller 15 and a discharge roller 16 discharge the recording material 2 onto which the toner images are fixed.

(Configuration of Fixing Unit)

Figure 2:
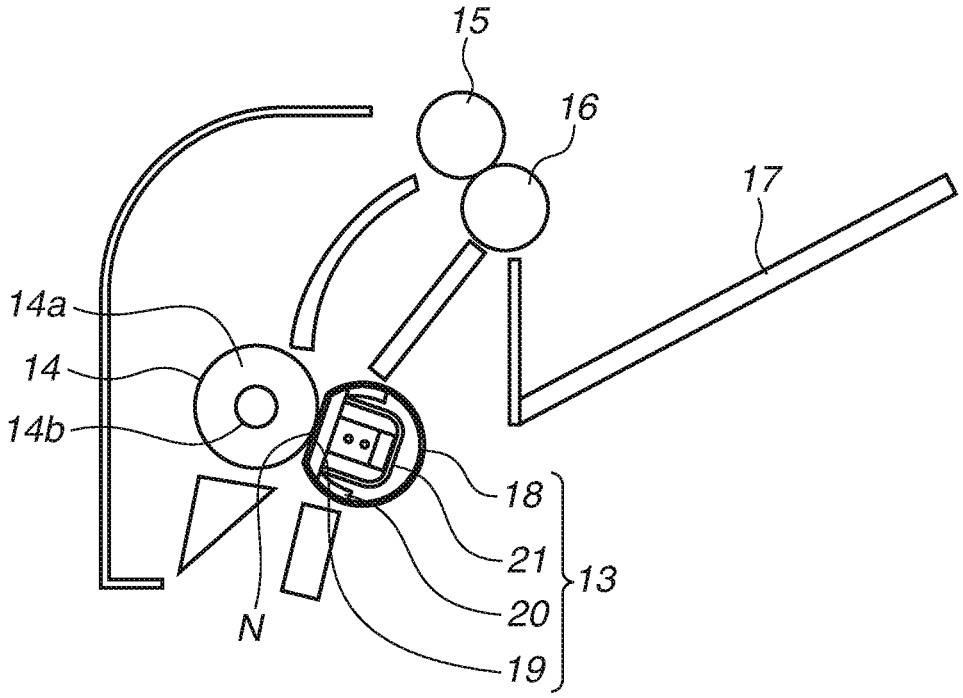
FIG. 2 is a schematic diagram illustrating a fixing unit, according to one or more embodiments of the subject disclosure.

Here, a fixing unit (a fixing device) according to a first exemplary embodiment will be described in detail. FIG. 2 is a schematic diagram illustrating the device. The heating unit 13 includes a fixing film 18, a heater 19, and a stay 21. The fixing film 18 has a cylindrical shape. The heater 19 is in contact with an inner surface of the fixing film 18. The holder 20 holds the heater 19. The stay 21 is made of metal and reinforces the holder 20. The fixing film 18 is, for example, a polyimide film having such properties that heat resistance is high and thermal conductivity is superior. The heater 19 is a ceramic heater or a carbon heater, and generates heat by receiving power supplied from a power supply (not illustrated). The heater 19 is held by the holder 20 in a state in which the heater is fitted in a groove portion of the holder 20. The heater 19, the holder 20, and the stay 21 are disposed in an internal space of the fixing film 18.

The heating unit 13 is configured to be brought into contact with the pressure roller 14 by a pressure spring (not illustrated). The pressure roller 14 is a roller for forming a fixing nip portion N with the heater 19 via the fixing film 18. The pressure roller 14 includes a metal core 14*a*, and a rubber layer 14*b* having heat resistance and provided around the metal core 14*a*. Since the pressure roller 14 has elasticity, the fixing nip portion N having a predetermined width is formed between the heating unit 13 and the pressure roller 14, when pressure is applied to both of these members. In addition, the pressure roller 14 is driven by a driving source (not illustrated). A frictional force is generated between the fixing film 18 and the pressure roller 14 by rotation the pressure roller 14. The fixing film 18 rotates by following the pressure roller 14. The fixing device fixes an image (the toner images) formed on the recording material 2 onto the recording material 2, while pinching and conveying the recording material 2 at the fixing nip portion. N. Thereafter, the recording material 2 having passed through the fixing nip portion. N is self-stripped and then conveyed to a downstream side of the fixing nip portion N. At the time, the recording material 2 passes through between guide members such as conveyance guides, and pinched and conveyed by the discharge roller 15 and the discharge roller 16 to be discharged to a tray 17.

Figure 3A:
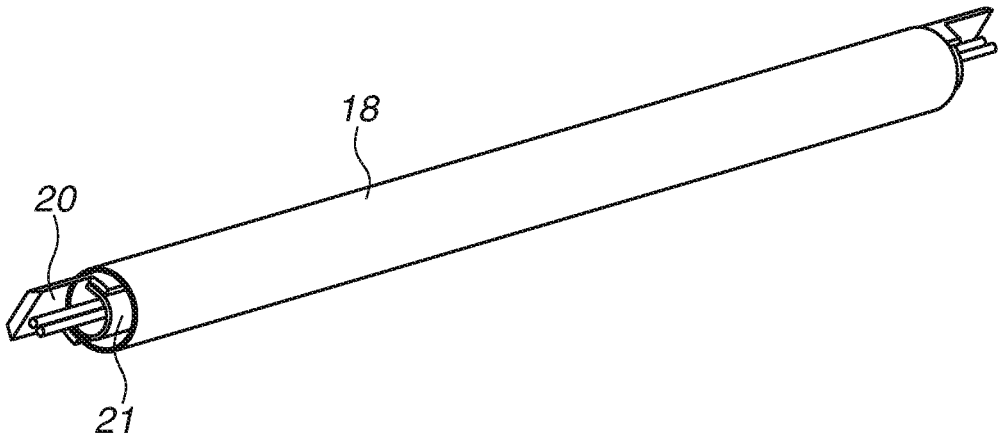
FIGS. 3A and 3B are schematic diagrams illustrating a heating unit, according to one or more embodiments of the subject disclosure.
Figure 3B:
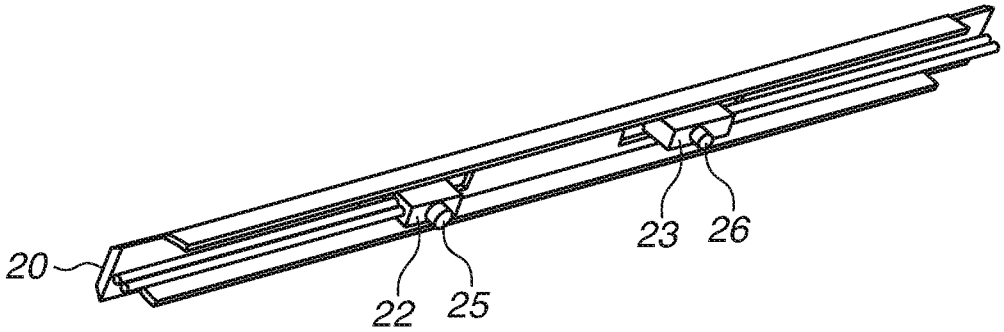

FIG. 3A is a perspective diagram illustrating the heating unit 13. FIG. 3B is a perspective diagram illustrating the heating unit 13 in a state that the fixing film 18 is removed. The heating unit 13 has a safety element 22 such as a thermistor or thermal fuse. The safety element 22 such as the thermistor or thermal fuse contains a switch portion that operates by receiving heat from the heater 19. The safety element 22 has a role in interrupting power supply to the heater 19. The safety element 22 is disposed to face a surface, which is opposite a surface in contact with the fixing film 18, of the heater 19. The safety element 22 is electrically disposed in a power-supply line.

A temperature detection element 23 is an element for detecting the temperature of the heater 19, such as a thermistor. The safety element 22 and the temperature detection element 23 are urged toward the heater 19 by a spring 25 and a spring 26, respectively, to operate stably.

Figure 4A:
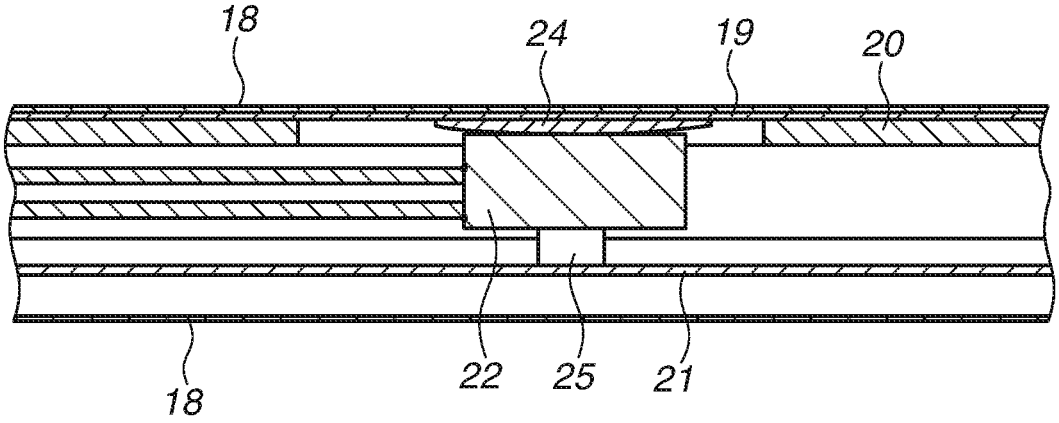
FIGS. 4A and 4B are cross-sectional diagrams illustrating the heating unit, according to one or more embodiments of the subject disclosure.
Figure 4B:
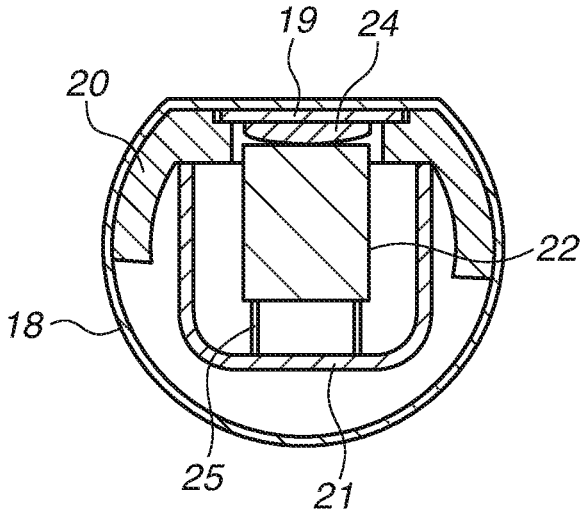

FIGS. 4A and 4B each illustrate a cross-sectional diagram illustrating the heating unit 13. A spacer 24 is provided between the safety element 22 and the heater 19. The safety element 22 and the spacer 24 are pressed against the heater 19 by the spring 25, and these three members remain in contact with each other.

The fixing device further includes a separation mechanism (not illustrated) for moving the heater 19 in a direction for separating the pressure roller 14 and the heater 19.

(Details of Spacer)

Figure 5:
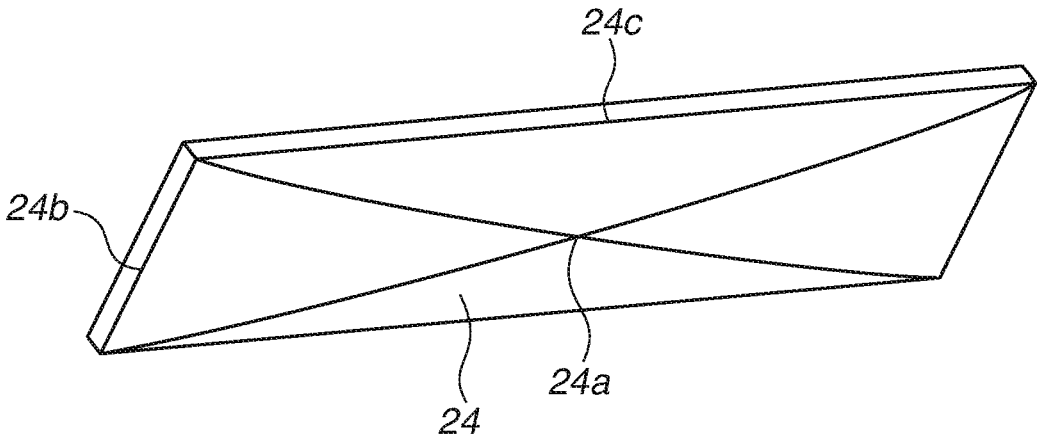
FIG. 5 is a schematic diagram illustrating a spacer, according to one or more embodiments of the subject disclosure.
Figure 6A:
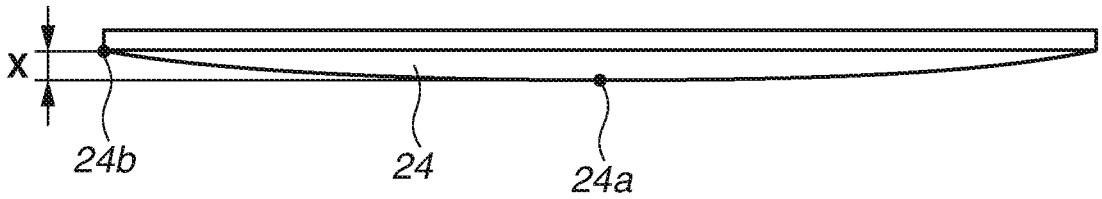
FIGS. 6A and 6B are cross-sectional diagrams illustrating the spacer, according to one or more embodiments of the subject disclosure.
Figure 6B:
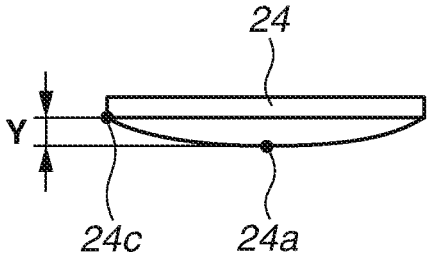

Next, the spacer 24 will be described in detail. FIG. 5 is a perspective diagram illustrating the spacer 24. FIG. 6A is a cross-sectional diagram illustrating the spacer 24 as viewed from a downstream side of a recording material conveyance direction. FIG. 6B is a cross-sectional diagram illustrating the spacer 24 as viewed from one end side in a longitudinal direction of the heating unit 13.

A surface on one side of the spacer 24 is a flat surface, and a surface on the other side of the spacer 24 has a curved surface shape. The flat surface side is contact with the heater 19, and the curved surface side is contact with the safety element 22. In this curved surface shape, an end portion is thinner than the center. In the present exemplary embodiment, an end portion is similarly thinner in both of the longitudinal direction and a widthwise direction of the heater 19. In addition, the curved surface shape is a gentle crown shape that allows, when the heater 19 tilts, the spacer 24 to also tilt to follow the tilting of the heater 19. More specifically, the spacer 24 has an area in contact with the safety element 22, and this area is smaller than an area of the spacer 24 in contact with the heater 19. The spacer 24 can thin tilt relative to the safety element 22. The spacer 24 has a crown shape in which, of the surface on the side in contact with the safety element 22, an end portion is further away from the safety element 22 than a central portion.

Next, the crown shape will be described. Assume that a thickness difference between a central portion 24*a* and an end portion 24*b* of the spacer 24 in the longitudinal direction of the heater 19 is X, and a thickness difference between the central portion 24*a* and an end portion 24*c* of the spacer 24 in the widthwise direction of the heater 19 is Y. A minimum value of each of the thickness differences X and Y needs to be small to the extent that the spacer 24 and the safety element 22 are not in surface contact with each other even if the spacer 24 bends when the heating unit 13 receives pressure from the pressure roller 14. Further, in consideration of preventing the curved surface shape of the central portion 24*a* and the end portions 24*b* and 24*c* from reversing in terms of manufacturing tolerance of the spacer 24, it is necessary for each of the thickness difference X between the central portion 24*a* and the end portion 24*b* and the thickness difference Y between the central portion 24*a* and the end portion 24*c* to be 100 μm or more.

In addition, the larger the thickness difference X between the central portion 24*a* and the end portion 24*b* and the thickness difference Y between the central portion 24*a* and the end portion 24*c* are, the more likely the spacer can tilt. Accordingly, the spacer 24 can follow the heater 19, even when parallelism between the heater 19 and the safety element 22 is lost due to a reduction in pressing force applied to the safety element 22, as at the time of the pressure release for moving the heater 19 from the pressure roller 14 by the separation mechanism described above. In the fixing device according to the present exemplary embodiment, the heater 19 and the spacer 24 remain in a contact state, even when the heater 19 is moved by the separation mechanism.

However, the full length of the spacer 24 used in a laser beam printer is approximately 10 mm. It is unlikely that the parallelism between the heater 19 and the safety element 22 is lost to the extent that the spacer 24 of such a short full length needs to tilt in millimeters. Moreover, if the thickness differences X and Y are too large, the wall thickness of the central portion 24*a* is too large, and thus it takes a longer time for the spacer 24 to melt. Accordingly, the thickness difference X between the central portion 24*a* and the end portion 24*b* and the thickness difference Y between the central portion 24*a* and the end portion 24*c* can each be suppressed to approximately 500 μm or less.

(Details of Spacer)

Figure 7:
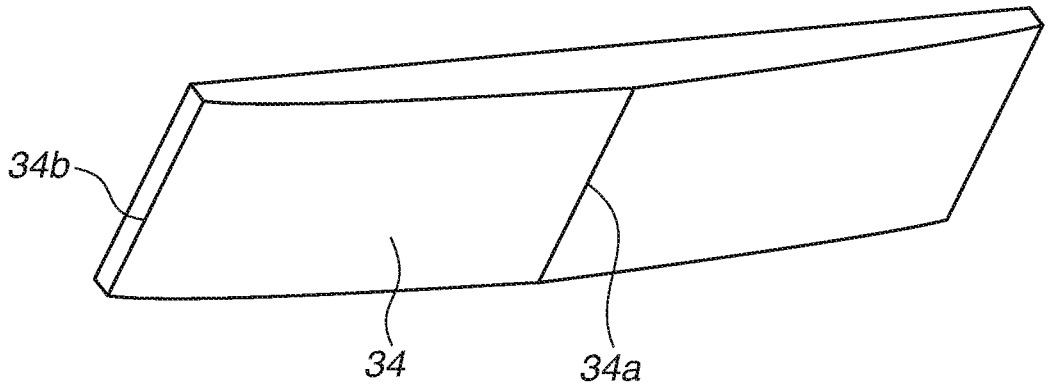
FIG. 7 is a schematic diagram illustrating a spacer, according to one or more embodiments of the subject disclosure.
Figure 8A:
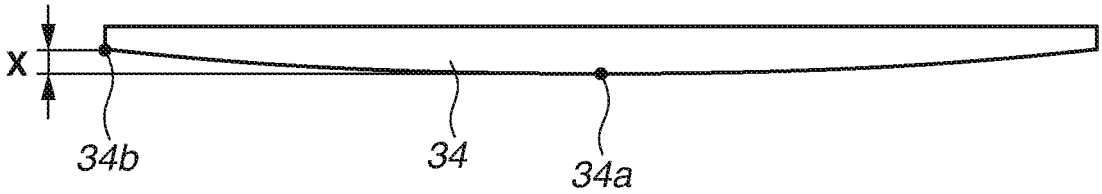
FIGS. 8A and 8B are cross-sectional diagrams illustrating the spacer, according to one or more embodiments of the subject disclosure.
Figure 8B:
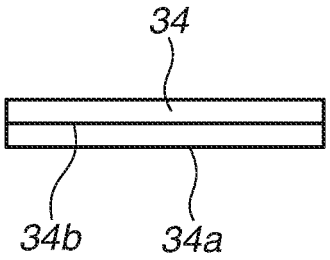

A spacer 34 according to a second exemplary embodiment will be described in detail. FIG. 7 is a perspective diagram illustrating the spacer 34. FIG. 8A is a cross-sectional diagram illustrating the spacer 34 as viewed from the downstream side of the recording material conveyance direction. FIG. 8B is a cross-sectional diagram illustrating the spacer 34 as viewed from one end side in the longitudinal direction of the heating unit 13.

A surface on one side of the spacer 34 is a flat surface, and a surface on the other side of the spacer 34 has a curved surface shape. The flat surface side is in contact with the heater 19, and the curved surface side is in contact with the safety element 22. In this curved surface shape, an end portion is thinner than the center in the longitudinal direction of the heater 19. In addition, this curved surface shape is a gentle crown shape that provides such a configuration that, when the heater 19 tilts, the spacer 34 can also tilt to follow the tilting of the heater 19.

Next, the crown shape will be described. Assume that a thickness difference between a central portion 34*a* and an end portion 34*b* of the spacer 34 is X. A minimum value of the thickness difference X needs to be small, to the extent that surface contact does not occur even if the spacer 34 bends when the heating unit 13 receives pressure from the pressure roller 14. Further, in consideration of preventing the curved surface shape of the central portion 34*a* and the end portion 34*b* from reversing in terms of manufacturing tolerance of the spacer 34, it is necessary for the thickness difference X between the central portion 34*a* and the end portion 34*b* to be 100 μm or more.

In addition, the larger the thickness difference X between the central portion 34*a* and the end portion 34*b* is, the more likely the spacer 34 can tilt. Accordingly, the spacer 34 can follow the heater 19, even when the parallelism between the heater 19 and the safety element 22 is lost due to a reduction in pressing force applied to the safety element 22, as at the time of the pressure release. Moreover, the thickness difference X between the central portion 34*a* and the end portion 34*b* can be suppressed to approximately 500 μm or less.

As described in the first and second exemplary embodiments, the spacer can have such a configuration that the contact surface thereof is in point contact or line contact with the safety element, or in contact with the safety element at a plurality of aligned points.

Moreover, a spacer like those described in the first and second exemplary embodiments may be provided in a fixing device, which has such a configuration that a heat transfer plate having higher thermal conductivity than that of a heater is provided between the spacer and the heater. In this case, there can be adopted such a configuration that the heat transfer plate and the spacer remain in a contact state, even when the heater is moved by a separation mechanism.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-233356, filed Nov. 30, 2016, which is hereby incorporated by reference herein in its entirety.

What is claimed is:

1. A fixing device for fixing an image formed on a recording material onto the recording material, the fixing device comprising:

a film having a cylindrical shape;

a heater in contact with an inner surface of the film;

a roller forming a fixing nip portion with the heater via the film;

a safety element having a switch portion that operates by receiving heat from the heater, and configured to interrupt power supply to the heater; and a spacer disposed between the heater and the safety element, wherein the spacer is provided independently from the heater, wherein, when a temperature of the heater reaches an abnormally high temperature, the spacer melts, and after that, the safety element is operated, wherein the fixing device fixes the image formed on the recording material onto the recording material by using heat of the heater, while pinching and conveying the recording material at the fixing nip portion, wherein the spacer is in contact with a part of the heater in a longitudinal direction of the heater, when the fixing device is viewed from the fixing nip portion in a conveying direction of the recording material, wherein an area of the spacer in contact with the safety element is smaller than an area of the spacer in contact with the heater, and the spacer is tiltable relative to the safety element, and wherein the spacer has a crown shape in which, of a surface of the spacer on a side in contact with the safety element, an end portion is further away from the safety element than a central portion.

2. The fixing device according to claim 1, wherein the spacer has a contact surface in point contact or line contact with the safety element, or is in contact with the safety element at a plurality of aligned points.

3. The fixing device according to claim 1, further comprising a heat transfer plate having thermal conductivity higher than thermal conductivity of the heater and provided between the spacer and the heater.

* * * * *